US009921538B2

(12) United States Patent
Tanaka

(10) Patent No.: US 9,921,538 B2
(45) Date of Patent: Mar. 20, 2018

(54) IMAGE FORMING APPARATUS AND BIAS POWER-SUPPLY DEVICE

(71) Applicant: FUJI XEROX CO., LTD., Tokyo (JP)

(72) Inventor: Koya Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/019,317

(22) Filed: Feb. 9, 2016

(65) Prior Publication Data

US 2017/0090393 A1 Mar. 30, 2017

(30) Foreign Application Priority Data

Sep. 24, 2015 (JP) ..... 2015-187480

(51) Int. Cl.
*G03G 15/00* (2006.01)
*G03G 15/02* (2006.01)
*G03G 15/06* (2006.01)

(52) U.S. Cl.
CPC ..... *G03G 15/80* (2013.01); *G03G 15/0283* (2013.01); *G03G 15/065* (2013.01); *G03G 15/5004* (2013.01)

(58) Field of Classification Search
CPC . G03G 15/80; G03G 15/5004; G03G 15/0283
See application file for complete search history.

(56) References Cited

U.S. PATENT DOCUMENTS 4,386,394 A * 5/1983 Kocher ..... H02J 1/102 363/20
4,562,524 A * 12/1985 Mutoh ..... H02M 7/53873 327/172
8,891,985 B2 11/2014 Tanaka
9,025,988 B2 5/2015 Nakagawa
2005/0046387 A1* 3/2005 Aker ..... H02J 7/0042 320/125
2010/0213769 A1* 8/2010 Sakakibara ..... H02M 5/297 307/82

FOREIGN PATENT DOCUMENTS

JP 06194908 A * 7/1994
JP 2013-255332 A 12/2013
JP 2014-68446 A 4/2014
JP 5552978 B2 7/2014

* cited by examiner

*Primary Examiner* — David M Gray
*Assistant Examiner* — Laura Roth
(74) *Attorney, Agent, or Firm* — Sughrue Mion, PLLC

(57) ABSTRACT

A bias power-supply device of an image forming apparatus includes a transformer that includes a first winding and a second winding, and outputs an alternating-current output signal from the second winding when the first winding is supplied with current; a switch circuit that includes a switching element, and supplies the first winding of the transformer with the current by switching the switching element in accordance with a received modulation output signal; and a modulation circuit that receives a frequency setting signal of setting a frequency of the alternating-current output signal and a modulation signal, and generates the modulation output signal having a modulated pulse width. A frequency of the modulation signal and a frequency of the alternating-current output signal are set to cause an interference frequency between the modulation signal and a harmonic of the alternating-current output signal is higher than a predetermined frequency.

10 Claims, 8 Drawing Sheets

PROCESS SPEED v: 308 mm/s
AC-OUTPUT-SIGNAL FREQUENCY: 2438 Hz

| INTERFERENCE FREQUENCY f (Hz) | 88 | 103 | 123 | 154 | 205 | 308 | 411 | 616 |
|---|---|---|---|---|---|---|---|---|
| BANDING PITCH p (mm) | 3.5 | 3 | 2.5 | 2 | 1.5 | 1 | 0.75 | 0.5 |
| EVALUATION RESULT | × | ○ | ○ | ○ | ○ | ○ | ◎ | ◎ |

◎ : NO BANDING
○ : SLIGHT BANDING
× : NOTICEABLE BANDING

FIG. 6

REFERENCE-SIGNAL FREQUENCY: 50 MHz
AC-OUTPUT-SIGNAL FREQUENCY: 2800.0224 Hz (DIVISION RATIO: 17857)

| HARMONIC OF AC OUTPUT SIGNAL | | MODULATION SIGNAL | | INTERFERENCE FREQUENCY (Hz) |
|---|---|---|---|---|
| INTEGRAL MULTIPLE | FREQUENCY (Hz) | DIVISION RATIO | FREQUENCY (Hz) | |
| 28 | 78400.62721 | 638 | 78369.90596 | 30.721249 |
| 29 | 81200.64961 | 616 | 81168.83117 | 31.818436 |
| 30 | 84000.67201 | 595 | 84033.61345 | 32.941440 |
| 31 | 86800.69441 | 576 | 86805.55556 | 4.861150 |
| 32 | 89600.71681 | 558 | 89605.73477 | 5.017961 |
| 33 | 92400.73921 | 541 | 92421.44177 | 20.702569 |
| 34 | 95200.76161 | 525 | 95238.09524 | 37.333632 |
| 35 | 98000.78401 | 510 | 98039.21569 | 38.431680 |
| 36 | 100800.80641 | 496 | 100806.45161 | 5.645206 |

FIG. 7A

REFERENCE-SIGNAL FREQUENCY: 50 MHz
AC-OUTPUT-SIGNAL FREQUENCY: 2800.0224 Hz (DIVISION RATIO: 17857)

| HARMONIC OF AC OUTPUT SIGNAL | | MODULATION SIGNAL | | INTERFERENCE FREQUENCY (Hz) | |
|---|---|---|---|---|---|
| INTEGRAL MULTIPLE | FREQUENCY (Hz) | DIVISION RATIO | FREQUENCY (Hz) | INTERFERENCE BETWEEN AC OUTPUT SIGNAL AND MODULATION SIGNAL | INTERFERENCE BETWEEN INTERFERENCES |
| 33 | 92400.73921 | | | 1407.891188 | |
| | | 533 | 93808.63039 | | 15.759976 |
| 34 | 95200.76161 | | | 1392.131212 | |

FIG. 7B

REFERENCE-SIGNAL FREQUENCY: 50 MHz
AC-OUTPUT-SIGNAL FREQUENCY: 2800.0224 Hz (DIVISION RATIO: 17857)

| HARMONIC OF AC OUTPUT SIGNAL | | MODULATION SIGNAL | | INTERFERENCE FREQUENCY (Hz) | |
|---|---|---|---|---|---|
| INTEGRAL MULTIPLE | FREQUENCY (Hz) | DIVISION RATIO | FREQUENCY (Hz) | INTERFERENCE BETWEEN AC OUTPUT SIGNAL AND MODULATION SIGNAL | INTERFERENCE BETWEEN INTERFERENCES |
| 33 | 92400.73921 | | | 1057.204719 | |
| | | 535 | 93457.94393 | | 685.612962 |
| 34 | 95200.76161 | | | 1742.817681 | |

FIG. 8

PROCESS SPEED v: 308 mm/s
AC-OUTPUT-SIGNAL FREQUENCY: 2438 Hz

| INTERFERENCE FREQUENCY f (Hz) | 88 | 103 | 123 | 154 | 205 | 308 | 411 | 616 |
|---|---|---|---|---|---|---|---|---|
| BANDING PITCH p (mm) | 3.5 | 3 | 2.5 | 2 | 1.5 | 1 | 0.75 | 0.5 |
| EVALUATION RESULT | × | ○ | ○ | ○ | ○ | ○ | ◎ | ◎ |

◎ : NO BANDING
○ : SLIGHT BANDING
× : NOTICEABLE BANDING

IMAGE FORMING APPARATUS AND BIAS POWER-SUPPLY DEVICE

CROSS-REFERENCE TO RELATED APPLICATIONS

This application is based on and claims priority under 35 USC 119 from Japanese Patent Application No. 2015-187480 filed Sep. 24, 2015.

BACKGROUND

The present invention relates to an image forming apparatus and a bias power-supply device.

SUMMARY

According to an aspect of the invention, there is provided an image forming apparatus including an image carrier; a charging unit that charges the image carrier with electricity; an exposure unit that exposes the image carrier charged with the electricity by the charging unit to light, and forms an electrostatic latent image on the image carrier; a developing unit that develops the electrostatic latent image formed on the image carrier by the exposure to the light by the exposure unit; and a transfer unit that transfers the developed image on a transfer material. At least one of the charging unit and the developing unit uses an electric field in which alternating current and direct current are superposed, the electric field being generated by a bias power supply. The bias power supply includes a transformer that includes a first winding and a second winding, and outputs an alternating-current output signal from the second winding when the first winding is supplied with current; a switch circuit that includes a switching element, and supplies the first winding of the transformer with the current by switching the switching element in accordance with a received modulation output signal; and a modulation circuit that receives a frequency setting signal of setting a frequency of the alternating-current output signal and a modulation signal, and generates the modulation output signal having a modulated pulse width. A frequency of the modulation signal and a frequency of the alternating-current output signal are set to cause an interval of stripes with different densities generated on the transfer material by interference between the modulation signal and a harmonic of the alternating-current output signal to be smaller than a predetermined interval.

BRIEF DESCRIPTION OF THE DRAWINGS

An exemplary embodiment of the present invention will be described in detail based on the following figures, wherein:

FIG. 6 is an illustration explaining an alternating-current (AC) output signal, a modulation signal, and the relationship in interference frequency between the AC output signal and the modulation signal;

FIGS. 7A and 7B illustrate cases in which the frequencies of the modulation signals are set at, for example, a frequency being 33 times the frequency of the AC output signal and a frequency being 34 times the frequency of the AC output signal, FIG. 7A illustrating a case in which the frequency of the modulation signal is set at a frequency close to an intermediate frequency between the frequency being 33 times the frequency of the AC output signal and the frequency being 34 times the frequency of the AC output signal, FIG. 7B illustrating a case in which the frequency of the modulation signal is set at a frequency separated from the intermediate frequency between the frequency being 33 times the frequency of the AC output signal and the frequency being 34 times the frequency of the AC output signal; and FIG. 8 illustrates the result of evaluation on whether banding appears (is visually recognized) or not.

DETAILED DESCRIPTION

An exemplary embodiment of the present invention is described below in detail with reference to the accompanying drawings.

Image Forming Apparatus 1

Figure 1:
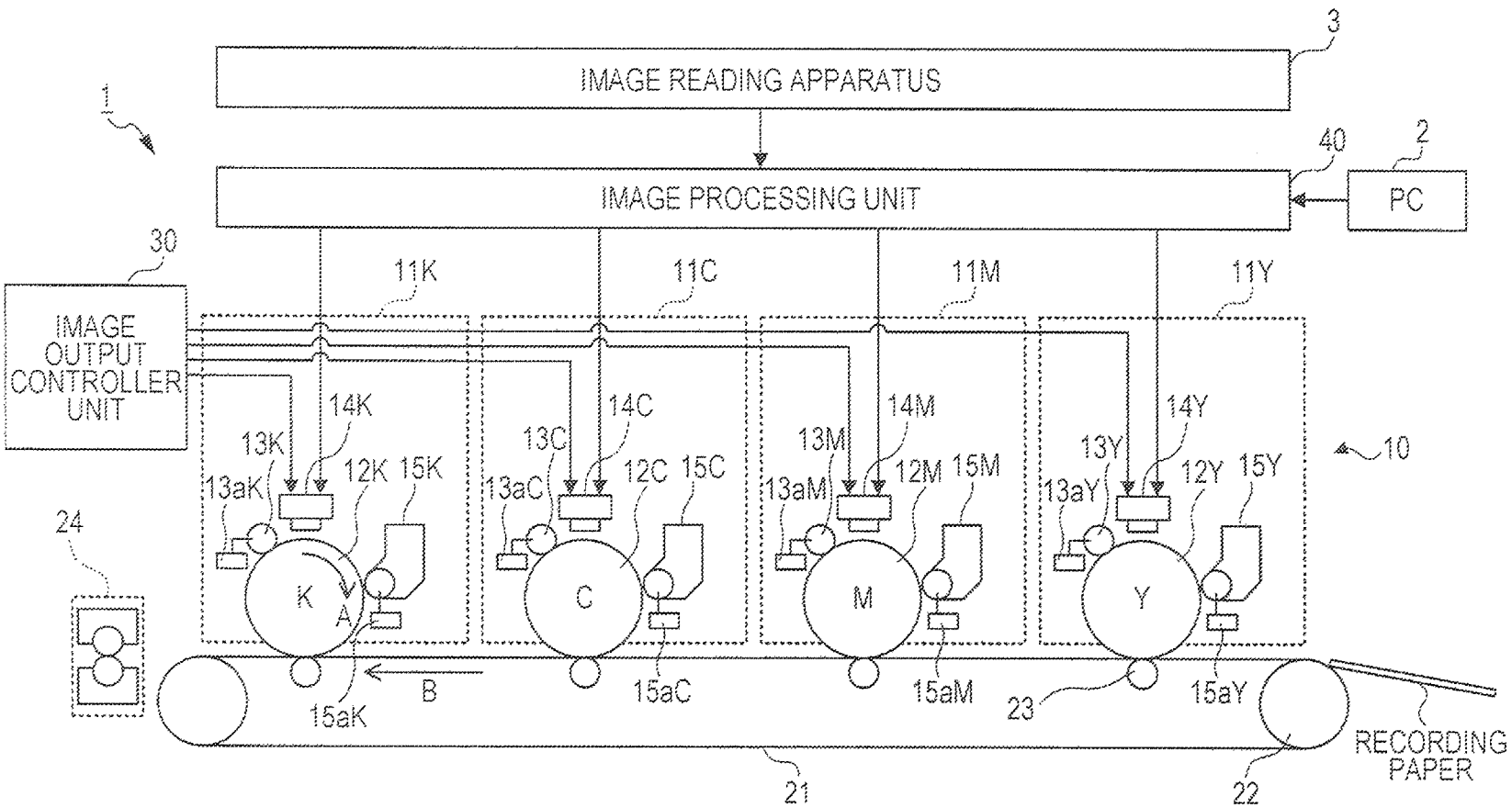
FIG. 1 illustrates an example of a general configuration of an image forming apparatus to which an exemplary embodiment is applied.

FIG. 1 illustrates an example of a general configuration of an image forming apparatus 1 to which this exemplary embodiment is applied. The image forming apparatus 1 shown in FIG. 1 is an image forming apparatus of typically called tandem system. The image forming apparatus 1 includes an image formation process unit 10 that executes image formation in accordance with image data of respective colors, an image output controller 30 that controls the image formation process unit 10, and an image processing unit 40 that is connected to, for example, a personal computer (PC) 2 or an image reading apparatus 3 and executes predetermined image processing on image data received from the PC 2 or the image reading apparatus 3.

The image formation process unit 10 includes plural image forming units 11Y, 11M, 11C, and 11K arranged in parallel at predetermined intervals. The image forming units 11Y, 11M, 11C, and 11K are collectively referred to as image forming unit 11 unless otherwise the image forming units 11Y, 11M, 11C, and 11K are distinguished from each other.

The image forming unit 11K includes a photoconductor drum 12K that forms an electrostatic latent image and carries a toner image, a charging roller 13K that charges the surface of the photoconductor drum 12K with a predetermined voltage (charging bias (charging electric field)), a print head 14K that exposes the photoconductor drum 12K electrically charged by the charging roller 13K to light, and a developing device 15K that develops the electrostatic latent image obtained by the print head 14K.

Further, a charging-bias power-supply unit 13*a*K that supplies the charging bias for electrically charging the photoconductor drum 12K is connected to the charging roller 13K, and a developing-bias power-supply unit 15*a*K that supplies a predetermined voltage (developing bias (developing electric field)) to the developing device 15K is connected to the developing device 15K.

The other image forming units 11Y, 11M, and 11C are configured similarly. That is, in the other image forming units 11Y, 11M, and 11C, the alphabetic character K of each of the photoconductor drum 12K, the charging roller 13K, the print head 14K, the developing device 15K, the charging-bias power-supply unit 13*a*K, and the developing-bias power-supply unit 15*a*K in the image forming unit 11K may be replaced with corresponding one of Y, M, and C. If the alphabetic characters Y, M, C, and K are not distinguished from each other, the respective components are merely referred to as photoconductor drum 12, charging roller 13, print head 14, developing device 15, charging-bias power-supply unit 13*a*, and developing-bias power-supply unit 15*a*.

However, the developing devices 15K, 15Y, 15M, and 15C house different toners. Accordingly, the image forming units 11Y, 11M, 11C, and 11K respectively form toner images of yellow (Y), magenta (M), cyan (C), and black (K).

In this case, the charging roller 13 is an example of a charging unit, the photoconductor drum 12 is an example of an image carrier, the print head 14 is an example of an exposure unit, and the developing device 15 is an example of a developing unit.

The charging roller 13 is formed by forming, for example, an epichlorohydrin rubber layer on the surface of a metal shaft, and further coating the surface of the epichlorohydrin rubber layer with polyamide containing conductive powder made of tin oxide by a thickness of about 3 μm.

The photoconductor drum 12 is formed by forming, for example, an organic photosensitive layer on the surface of a metal thin cylindrical drum, and the organic photosensitive layer is electrically charged to have negative polarity. Development by the developing device 15 is executed by reversal development system. Hence, the toner used in the developing device 15 is a negative-polarity charged toner.

To supply the charging bias to the charging roller 13, the voltage output from the charging-bias power-supply unit 13*a* is, for example, a voltage in which a direct-current (DC) voltage of −600 V (a DC output voltage Vdc, described later) is superposed on an alternating-current (AC) voltage having a frequency of 2 kHz and a peak-to-peak value (a p-p value) of 2 kV (an AC output current, described later).

Also, to supply the developing bias to the developing device 15, the voltage output from the developing-bias power-supply unit 15*a* is, for example, a voltage in which a DC voltage of −500 V is superposed on an AC voltage having a frequency of 8 kHz and a p-p value of 1 kV.

The charging-bias power-supply unit 13*a* and the developing-bias power-supply unit 15*a* in this exemplary embodiment are each a switching power supply of high-frequency modulation system (D-class power amplification system) that obtains AC or DC high-voltage output power by switching (turning on and off) a switching element (described later).

The switching power supply of high-frequency modulation system is effective for energy conservation.

Also, to transfer multiple toner images of the respective colors formed on the image forming units 11Y, 11M, 11C, and 11K in an overlap manner on a recording paper, which is an example of a transfer material, the image forming apparatus 1 includes a paper transport belt 21 that transports the recording paper, a driving roller 22 being a roller that drives the paper transport belt 21, a transfer roller 23, which is an example of a transfer unit that transfers the toner image of each photoconductor drum 12 on the recording paper, and a fixing device 24 that fixes the toner images to the recording paper.

In this image forming apparatus 1, the image formation process unit 10 executes an image forming operation based on various control signals supplied from the image output controller 30. Under the control by the image output controller 30, the image processing unit 40 executes the image processing on the image data received from the PC 2 or the image reading apparatus 3, and the processed data is supplied to the respective image forming units 11Y, 11M, 11C, and 11K. For example, in the image forming unit 11K of black (K) color, the photoconductor drum 12K is charged with the predetermined charging bias by the charging roller 13K and is exposed to light by the print head 14K, which emits light in accordance with the image data supplied from the image processing unit 40, while the photoconductor drum 12K rotates in a direction indicated by arrow A. Accordingly, an electrostatic latent image relating to an image of black (K) color is formed on the photoconductor drum 12K. The electrostatic latent image formed on the photoconductor drum 12K is developed by the developing device 15K and hence a toner image of black (K) color is formed on the photoconductor drum 12K.

In this case, reversal development system is used. The surface of the photoconductor drum 12K is charged with the charging bias (for example, the DC voltage of −600 V with the AC voltage superposed thereon). When an image is written by the print head 14K, the electrical conductivity of the surface of the photoconductor drum 12K is increased, and the voltage of a portion irradiated with light by the print head 14K becomes, for example, −200 V from −600 V. In contrast, the developing bias (for example, the DC voltage of −500 V with the AC voltage superposed thereon) is supplied to the developing device 15K containing a toner. Then, the negative polarity charged toner adheres to the portion with the voltage of −200 V on the surface of the photoconductor drum 12K. Accordingly, toner images of respective colors are formed.

Also in the image forming units 11Y, 11M, and 11C, toner images of respective colors including yellow (Y), magenta (M), and cyan (C) are formed.

The toner images of the respective colors formed by the respective image forming units 11 are sequentially electrostatically transferred on the recording paper supplied by movement of the paper transport belt 21, which moves in a direction indicated by arrow B, by a transfer electric field (a transfer bias) applied to the transfer rollers 23. Hence, a composite toner image including the superposed multiple toners of the respective colors is formed on the recording paper.

Then, the recording paper with the composite toner image electrostatically transferred is transported to the fixing device 24. The composite toner image on the recording paper transported to the fixing device 24 receives fixing processing using heat and pressure from the fixing device 24, and hence is fixed to the recording paper. The recording paper is output from the image forming apparatus 1.

Bias Power-Supply Device 100

Block Configuration of Bias Power-supply Device 100

In this case, it is assumed that a bias power-supply device 100 includes, for example, the charging-bias power-supply unit 13*a*K and a waveform setting unit 60. However, the bias power-supply device 100 may not include the waveform setting unit 60. Alternatively, instead of the charging-bias power-supply unit 13*a*K, the bias power-supply device 100 may include any one of the other charging-bias power-supply units 13$a$Y, 13$a$M, and 13$a$C.

Also, the bias power-supply device 100 may include frequency dividers 71 and 72.

In this case, the waveform setting unit 60, and the frequency dividers 71 and 72 are commonly provided for the charging-bias power-supply units 13$a$Y, 13$a$M, 13$a$C, and 13$a$K; however, may be provided for each of the charging-bias power-supply units 13$a$Y, 13$a$M, 13$a$C, and 13$a$K.

For another example, instead of the charging-bias power-supply unit 13$a$K, the bias power-supply device 100 may use the developing-bias power-supply unit 15$a$K. Alternatively, instead of the developing-bias power-supply unit 15$a$K, the bias power-supply device 100 may use any one of the other developing-bias power-supply units 15$a$Y, 15$a$M, and 15$a$C.

The bias power-supply device 100 operates similarly even if the charging-bias power-supply unit 13$a$ is replaced with the developing-bias power-supply unit 15$a$.

In the following description, the bias power-supply device 100 includes the charging-bias power-supply unit 13$a$K and the waveform setting unit 60, for an example. In this case, the bias power-supply device 100 uses the charging roller 13K as a load.

Figure 2:
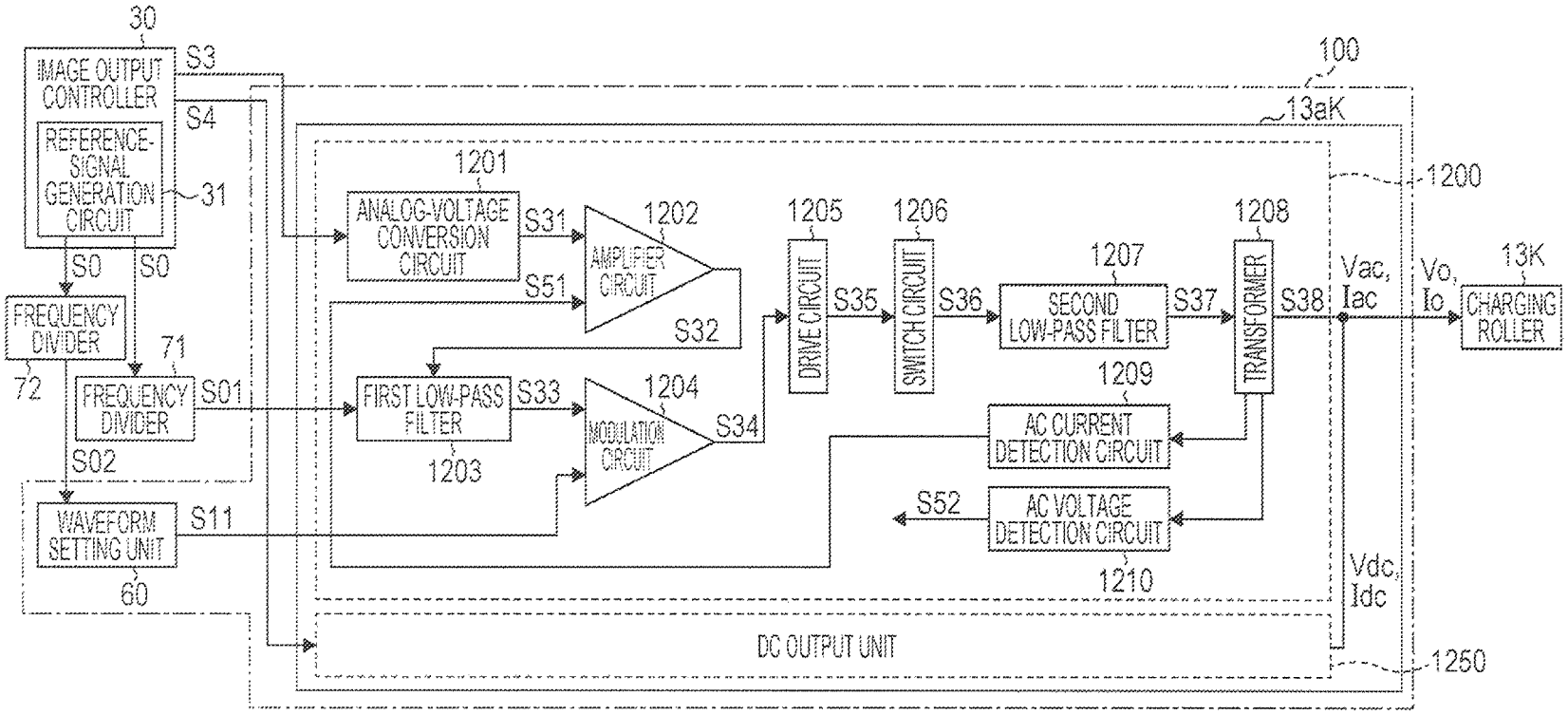
FIG. 2 is an illustration explaining an example of a block configuration of a bias power-supply device including a charging-bias power-supply unit and a waveform setting unit.

FIG. 2 is an illustration explaining an example of a block configuration of the bias power-supply device 100 including the charging-bias power-supply unit 13$a$K and the waveform setting unit 60.

The charging-bias power-supply unit 13$a$K includes an AC output unit 1200 and a DC output unit 1250.

The image output controller 30 transmits an AC current setting signal S3 to an analog-voltage conversion circuit 1201 (described later) of the AC output unit 1200, and transmits a DC voltage setting signal S4 to the DC output unit 1250.

Also, the image output controller 30 includes a reference-signal generation circuit (a transmission source) 31 that generates a reference signal S0. The reference-signal generation circuit 31 of the image output controller 30 transmits the reference signal S0 to the frequency dividers 71 and 72.

The frequency divider 71 is an example of a first frequency divider, and the frequency divider 72 is an example of a second frequency divider.

The frequency divider 71 transmits a clock signal S01 obtained by dividing the frequency of the reference signal S0 by using a predetermined division ratio to a first low-pass filter 1203 (described later) of the AC output unit 1200.

Also, the frequency divider 72 transmits a clock signal S02 obtained by dividing the frequency of the reference signal S0 by using another predetermined division ratio to the waveform setting unit 60. The waveform setting unit 60 sets (generates) a modulation signal S11 on the basis of the clock signal S02, and transmits the modulation signal S11 to a modulation circuit 1204 (described later) of the AC output unit 1200.

The reference signal S0, and the clock signals S01 and S02 are rectangular wave signals each having a duty ratio of 50%. Also, the modulation signal S11 is, for example, a triangular wave signal.

The image forming apparatus 1 is controlled by the image output controller 30 to operate with reference to the reference signal S0 generated by the reference-signal generation circuit 31. The bias power-supply device 100 also operates with reference to the reference signal S0 generated by the reference-signal generation circuit 31 of the image output controller 30. That is, the reference signal S0 generated by the reference-signal generation circuit 31 of the image output controller 30 is a source oscillation that controls the operation of the image forming apparatus 1.

The block configuration of the bias power-supply device 100 is described next in detail.

The AC output unit 1200 and the DC output unit 1250 are each a switching power supply that generates high-voltage output power by switching (turning on and off) a switching element. In FIG. 2, it is assumed that the AC output unit 1200 uses external drive system and the DC output unit 1250 uses self-drive system.

The AC output unit 1200 of the charging-bias power-supply unit 13$a$K includes the analog-voltage conversion circuit 1201, an amplifier circuit 1202, the first low-pass filter 1203, the modulation circuit 1204, a drive circuit 1205, a switch circuit 1206, a second low-pass filter 1207, a transformer 1208, an AC current detection circuit 1209, and an AC voltage detection circuit 1210.

In FIG. 2, illustration of the block configuration is omitted for the DC output unit 1250 of the charging-bias power-supply unit 13$a$K (see FIG. 3, described later).

In the following description, the configuration of the AC output unit 1200 is described below according to the relationship between transmission and reception of signals and the overview of operation.

The analog-voltage conversion circuit 1201 receives the AC current setting signal S3 from the image output controller 30. The AC current setting signal S3 is a signal treated with pulse width modulation (PWM), and sets a value of AC (sine wave) current Iac output from the transformer 1208 by a duty ratio. The duty ratio is, for example, in a range from 3% to 100%.

The analog-voltage conversion circuit 1201 generates a signal with a voltage corresponding to the duty ratio of the received AC current setting signal S3 (hereinafter, referred to as analog voltage signal S31), and transmits the analog voltage signal S31 to the amplifier circuit 1202.

The amplifier circuit 1202 receives the analog voltage signal S31 from the analog-voltage conversion circuit 1201, and a detection signal S51 from the AC current detection circuit 1209. The AC current detection circuit 1209 is described later in detail.

The amplifier circuit 1202 amplifies the difference between the voltage of the analog voltage signal S31 and the voltage of the detection signal S51, generates an error amplification signal S32, and transmits the error amplification signal S32.

The first low-pass filter 1203 receives the clock signal S01 and the error amplification signal S32 output from the amplifier circuit 1202. The first low-pass filter 1203 takes out an AC component from the clock signal S01, generates a frequency setting signal S33 in which a high-frequency component is blocked by the low-pass filter, and transmits the generated frequency setting signal S33. The frequency setting signal S33 has a waveform close to a sine wave. The amplitude (the p-p value) of the frequency setting signal S33 is set by the error amplification signal S32.

The frequency of the frequency setting signal S33 is set at the frequency of an AC output signal S38 output from the transformer 1208. The AC output signal S38 includes an AC output voltage Vac and an AC output current Iac.

The frequency setting signal S33 is a signal obtained by taking out a sine-wave component from the clock signal S01 being the rectangular wave signal with the duty ratio of 50%, and hence the frequency of the frequency setting signal S33 is a repetition frequency of the clock signal S01.

The modulation circuit 1204 receives the frequency setting signal S33 from the first low-pass filter 1203, and the modulation signal S11 from the waveform setting unit 60.

The modulation circuit 1204 compares the voltage of the frequency setting signal S33 with the voltage of the modulation signal S11, generates a modulation output signal S34 having a first voltage in a time period in which the voltage of the modulation signal S11 is higher than the voltage of the frequency setting signal S33, and a second voltage different from the first voltage in a time period in which the voltage of the modulation signal S11 is lower than the voltage of the frequency setting signal S33, and transmits the modulation output signal S34 to the drive circuit 1205. As described later, the modulation output signal S34 becomes a PWM signal having a pulse width set in accordance with the difference between the voltage of the modulation signal S11 and the voltage of the frequency setting signal S33.

The drive circuit 1205 receives the modulation output signal S34 from the modulation circuit 1204, converts the modulation output signal S34 into a driving signal S35 of driving the switch circuit 1206, and transmits the driving signal S35 to the switch circuit 1206. The driving signal S35 is also a PWM signal (described later).

The switch circuit 1206 includes two field-effect transistors FET1 and FET2 as switching elements (see FIG. 3, described later). The driving signal S35 is a PWM signal, and the field-effect transistors FET1 and FET2 of the switch circuit 1206 alternately repeat turning on and off (execute switching). Accordingly, when the switch circuit 1206 transmits a switch output signal S36 to the second low-pass filter 1207, the switch output signal S36 is a PWM signal following the driving signal S35.

The second low-pass filter 1207 blocks a high-frequency component of the switch output signal S36 received from the switch circuit 1206, hence generates a sine-wave signal S37, and transmits the sine-wave signal S37 to the transformer 1208. As described later, the sine-wave signal S37 is not a complete sine wave, and has a waveform with fluctuations (undulations or serrations).

The transformer 1208 has a first winding and a second winding. The first winding receives the sine-wave signal S37 from the second low-pass filter 1207. The second winding of the transformer 1208 outputs the AC output signal S38 of an AC output voltage Vac (an AC output current Iac) set by a winding ratio (the winding ratio between the first winding and the second winding).

The AC output signal S38 (the AC output voltage Vac (the AC output current Iac)) is superposed on a DC output voltage Vdc (a DC output current Idc) output from the DC output unit 1250 and becomes an output voltage Vo (an output current Io). The output voltage Vo (the output current Io) is applied to the charging roller 13K that charges the photoconductor drum 12K with electricity.

The AC current detection circuit 1209 detects (monitors) the AC output current Iac flowing to the photoconductor drum 12K through the charging roller 13K, and transmits the detection signal S51 of a DC voltage converted to be proportional to the AC output current Iac, to the amplifier circuit 1202.

The AC voltage detection circuit 1210 detects (monitors) the AC output voltage Vac applied to the charging roller 13K, and transmits a DC voltage detection signal S52, which is converted to be proportional to the AC output voltage Vac.

In FIG. 2, the amplifier circuit 1202 receives the detection signal S51 from the AC current detection circuit 1209, and executes feedback control (current control) to decrease the difference between the value set by the AC current setting signal S3 and the AC output current Iac. That is, if the AC output current Iac is higher than the value set by the AC current setting signal S3, the AC output voltage Vac is controlled to be decreased. If the AC output current Iac is lower than the value set by the AC current setting signal S3, the AC output voltage Vac is controlled to be increased.

In FIG. 2, no unit receives the detection signal S52 transmitted from the AC voltage detection circuit 1210. The amplifier circuit 1202 may receive the detection signal S52 instead of the detection signal S51 transmitted from the AC current detection circuit 1209. In this case, if the AC output voltage Vac is higher than a predetermined value, the AC output voltage Vac is controlled to be decreased. If the AC output voltage Vac is lower than the predetermined value, the AC output voltage Vac is controlled to be increased.

That is, the detection signal S52 of the AC voltage detection circuit 1210 may be used for overvoltage control.

If the bias power-supply device 100 includes the developing-bias power-supply unit 15*a*K (or any one of the other developing-bias power-supply units 15*a*Y, 15*a*M, and 15*a*C) instead of the charging-bias power-supply unit 13*a*K, the AC output voltage Vac is desirably controlled by feedback instead of the AC output current Iac.

That is, in the image forming apparatus 1, for the charging bias, the current is desirably held at a predetermined value, and for the developing bias, the voltage is desirably held at a predetermined value.

In the following description, the description on the AC voltage detection circuit 1210 is omitted.

In this case, it is assumed that the bias power-supply device 100 includes the charging-bias power-supply unit 13*a*K and the waveform setting unit 60. The charging-bias power-supply unit 13*a*K and the waveform setting unit 60 may be each formed on an individual circuit board, or may be both formed on a single (a piece of) circuit board. Also, the frequency dividers 71 and 72 may be formed on the circuit board formed with the charging-bias power-supply unit 13*a*K and the waveform setting unit 60.

Alternatively, the charging-bias power-supply unit 13*a*K may not be formed on a single (a piece of) circuit board, and may be formed on plural circuit boards.

Circuit Configuration of Charging-Bias Power-Supply Unit 13*a*K

Figure 3:
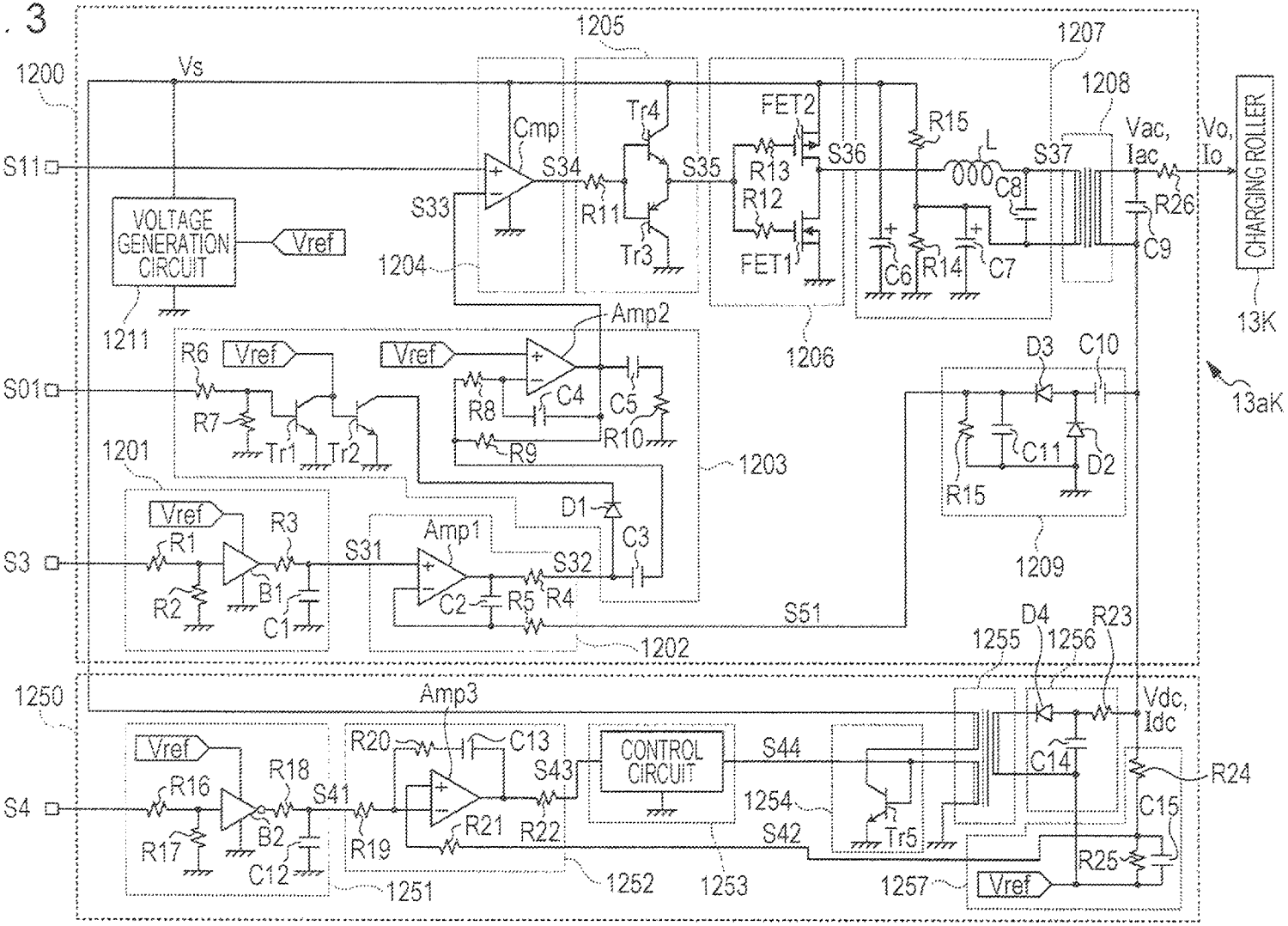
FIG. 3 illustrates an example of a circuit configuration of the charging-bias power-supply unit.

FIG. 3 illustrates an example of a circuit configuration of the charging-bias power-supply unit 13*a*K.

Respective blocks in FIG. 3 are arranged in a different way from FIG. 2 for easier understanding of description. Also, the arrangement of the respective blocks is merely schematic, and is not limited to this arrangement.

Also, the circuit configuration of the charging-bias power-supply unit 13*a*K shown in FIG. 3 is merely an example, and may have another circuit configuration, and may include other components (an error amplifier, a comparator, a buffer, a resistor, a capacitor, etc.) and other circuits.

FIG. 3 also illustrates an example of respective blocks of the DC output unit 1250, and circuit configurations of the respective blocks.

AC Output Unit 1200

The AC output unit 1200 is described first.

The analog-voltage conversion circuit 1201 includes a buffer B1, resistors R1, R2, and R3, and a capacitor C1.

The input terminal of the analog-voltage conversion circuit 1201 is one terminal of the resistor R1, and receives the AC current setting signal S3 from the image output controller 30. The other terminal of the resistor R1 is connected to the input terminal of the buffer B1. Also, the input terminal of the buffer B1 is connected to one terminal of the resistor R2. The other terminal of the resistor R2 is grounded (a ground voltage GND).

The output terminal of the buffer B1 is connected to one terminal of the resistor R3. The other terminal of the resistor R3 is the output terminal of the analog-voltage conversion circuit 1201, and transmits the analog voltage signal S31. Further, the other terminal of the resistor R3 is connected to one terminal of the capacitor C1. The other terminal of the capacitor C1 is grounded (the ground voltage GND).

Also, the buffer B1 is supplied with a reference voltage Vref and the ground voltage GND.

When the analog-voltage conversion circuit 1201 receives the AC current setting signal S3 being a PWM signal, the capacitor C1 is charged with a voltage between the reference voltage Vref and the ground voltage GND. This voltage is determined by the duty ratio of the AC current setting signal S3. Accordingly, the AC current setting signal S3 being the PWM signal is converted into the analog voltage signal S31 with the DC voltage.

The amplifier circuit 1202 includes an error amplifier Amp1, resistors R4 and R5, and a capacitor C2.

A non-inverting input terminal (hereinafter, referred to as positive input terminal) of the error amplifier Amp1 is connected to the other terminal of the resistor R3 being the output terminal of the analog-voltage conversion circuit 1201, and receives the analog voltage signal S31. An inverting input terminal (hereinafter, referred to as negative input terminal) of the error amplifier Amp1 is connected to one terminal of the resistor R5. The other terminal of the resistor R5 is connected to the AC current detection circuit 1209, and receives the detection signal S51.

The output terminal of the error amplifier Amp1 is connected to one terminal of the resistor R4. The other terminal of the resistor R4 is the output terminal of the amplifier circuit 1202.

The capacitor C2 provides connection between the negative input terminal of the error amplifier Amp1 and the output terminal of the error amplifier Amp1.

The error amplifier Amp1 amplifies the difference between the voltage of the analog voltage signal S31 and the voltage of the detection signal S51, and generates the error amplification signal S32. The error amplification signal S32 is transmitted from the other terminal of the resistor R4 being the output terminal of the amplifier circuit 1202 to the first low-pass filter 1203.

The first low-pass filter 1203 includes an error amplifier Amp2, npn transistors Tr1 and Tr2, resistors R6, R7, R8, R9, and R10, a diode D1, and capacitors C3, C4, and C5.

One terminal of the resistor R6 is the input terminal of the first low-pass filter 1203, and receives the clock signal S01 from the frequency divider 71 (see FIG. 2). The other terminal of the resistor R6 is connected to the base terminal of the npn transistor Tr1. The emitter terminal of the npn transistor Tr1 is grounded (the ground voltage GND), and the collector terminal of the npn transistor Tr1 is connected to the base terminal of the npn transistor Tr2. The emitter terminal of the npn transistor Tr2 is grounded (the ground voltage GND), and the collector terminal of the npn transistor Tr2 is connected to the cathode terminal of the diode D1. The collector terminal of the npn transistor Tr1 (the base terminal of the npn transistor Tr2) is supplied with a reference voltage Vref.

Also, one terminal of the resistor R7 is connected to the base terminal of the npn transistor Tr1, and the other terminal of the resistor R7 is grounded (the ground voltage GND).

The anode terminal of the diode D1 is connected to the other terminal of the resistor R4 being the output terminal of the amplifier circuit 1202. Also, the anode terminal of the diode D1 is connected to one terminal of the capacitor C3.

The other terminal of the capacitor C3 is connected to one terminal of the resistor R8 and one terminal of the resistor R9. The other terminal of the resistor R8 is connected to the negative input terminal of the error amplifier Amp2, and to one terminal of the capacitor C4. The other terminal of the capacitor C4 is connected to the output terminal of the error amplifier Amp2. The other terminal of the resistor R9 is also connected to the output terminal of the error amplifier Amp2. The output terminal of the error amplifier Amp2 is grounded (the ground voltage GND) through the capacitor C5 and the resistor R10. The output terminal of the error amplifier Amp2 is the output terminal of the first low-pass filter 1203.

The positive input terminal of the error amplifier Amp2 is supplied with a reference voltage Vref.

In this case, the resistors R6 and R7 prevent current from excessively flowing to the npn transistor Tr1.

The npn transistor Tr1 serves as an input buffer. The npn transistor Tr2, together with the diode D1, modulates the error amplification signal S32 by using the clock signal S01.

The capacitor C3 is a coupling capacitor, and takes out an AC component from the error amplification signal S32 modulated by using the clock signal S01.

The error amplifier Amp2, the resistors R8, R9, and R10, and the capacitors C4 and C5 form a low-pass filter, blocks a high-frequency component, and generates the frequency setting signal S33 being a sine wave.

The frequency setting signal S33 is transmitted from the output terminal of the error amplifier Amp2, being the output terminal of the first low-pass filter 1203, to the modulation circuit 1204.

The amplitude (the p-p value) of the frequency setting signal S33 is set by the error amplification signal S32.

A voltage generation circuit 1211, which is not illustrated in FIG. 2, is described now. The voltage generation circuit 1211 generates a reference voltage Vref on the basis of a power-supply voltage Vs. Then, the voltage generation circuit 1211 supplies the power-supply voltage Vs to the modulation circuit 1204, the drive circuit 1205, the switch circuit 1206, and the second low-pass filter 1207. The power-supply voltage Vs is, for example, 24 V.

The modulation circuit 1204 is described next.

The modulation circuit 1204 includes a comparator Cmp. The positive input terminal of the comparator Cmp receives the modulation signal S11. The negative input terminal of the comparator Cmp is connected to the output terminal of the first low-pass filter 1203 (the output terminal of the error amplifier Amp2), and receives the frequency setting signal S33. The output terminal of the comparator Cmp is connected to the drive circuit 1205.

The comparator Cmp compares the voltage of the frequency setting signal S33 with the voltage of the modulation signal S11, generates the modulation output signal S34 that becomes the power-supply voltage Vs in a time period in which the voltage of the modulation signal S11 is higher than the voltage of the frequency setting signal S33 and that becomes the ground voltage GND in a time period in which the voltage of the modulation signal S11 is lower than the voltage of the frequency setting signal S33, and transmits the modulation output signal S34. The modulation output signal S34 becomes a PWM signal having a pulse width set in accordance with the difference between the voltage of the modulation signal S11 and the voltage of the frequency setting signal S33.

The drive circuit 1205 includes a pnp transistor Tr3, an npn transistor Tr4, and a resistor R11.

One terminal of the resistor R11 is the input terminal of the drive circuit 1205, is connected to the output terminal of the comparator Cmp of the modulation circuit 1204, and receives the modulation output signal S34. The other terminal of the resistor R11 is commonly connected to the base terminal of the pnp transistor Tr3 and the base terminal of the npn transistor Tr4. The collector terminal of the pnp transistor Tr3 is grounded (the ground voltage GND), and the collector terminal of the npn transistor Tr4 is set at the power-supply voltage Vs. The emitter terminal of the pnp transistor Tr3 and the emitter terminal of the npn transistor Tr4 are connected to each other and serve as the output terminal of the drive circuit 1205. The output terminal of the drive circuit 1205 transmits the driving signal S35 to the switch circuit 1206.

The resistor R11 prevents current from excessively flowing to the pnp transistor Tr3 and the npn transistor Tr4.

If the modulation output signal S34 is the ground voltage GND, the pnp transistor Tr3 is turned on, the npn transistor Tr4 is turned off, and the driving signal S35 becomes the ground voltage GND. If the modulation output signal S34 is the power-supply voltage Vs, the pnp transistor Tr3 is turned off, the npn transistor Tr4 is turned on, and the driving signal S35 becomes the driving signal Vs.

That is, the driving signal S35 becomes a PWM signal having the same magnitude relationship of voltages as that of the modulation output signal S34. The drive circuit 1205 functions as a buffer that supplies current for driving to the switch circuit 1206.

The switch circuit 1206 includes an n-channel field-effect transistor FET1, a p-channel field-effect transistor FET2, and resistors R12 and R13.

One terminal of the resistor R12 and one terminal of the resistor R13 are commonly connected, hence serve as the input terminal of the switch circuit 1206, and receives the driving signal S35 from the drive circuit 1205. The other terminal of the resistor R12 is connected to the gate terminal of the field-effect transistor FET1, and the other terminal of the resistor R13 is connected to the gate terminal of the field-effect transistor FET2. The source terminal of the field-effect transistor FET1 is grounded (the ground voltage GND), and the source terminal of the field-effect transistor FET2 is set at the power-supply voltage Vs. Further, the drain terminal of the field-effect transistor FET1 and the drain terminal of the field-effect transistor FET2 are connected to each other, hence serve as the output terminal of the switch circuit 1206, and transmits the switch output signal S36.

If the driving signal S35 is the ground voltage GND, the field-effect transistor FET1 is turned off and the field-effect transistor FET2 is turned on, and the switch output signal S36 of the switch circuit 1206 becomes the power-supply voltage Vs. In contrast, if the driving signal S35 is the power-supply voltage Vs, the field-effect transistor FET1 is turned on and the field-effect transistor FET2 is turned off, and the switch output signal S36 becomes the ground voltage GND. That is, the switch output signal S36 of the switch circuit 1206 becomes a PWM signal having the inverted magnitude relationship of voltages with respect to the driving signal S35.

The second low-pass filter 1207 includes an inductance L, resistors R14 and R15, and capacitors C6, C7, and C8.

One terminal of the inductance L is connected to the output terminal of the switch circuit 1206, and receives the switch output signal S36. The other terminal of the inductance L is connected to one terminal of the first winding of the transformer 1208. The resistors R14 and R15 are connected in series between the power-supply voltage Vs and the ground voltage GND. The midpoint (the node between the resistors R14 and R15) is connected to the other terminal of the first winding of the transformer 1208.

The capacitor C8 is connected between one terminal and the other terminal of the first winding of the transformer 1208.

An LC circuit including the inductance L and the capacitor C8 forms a low-pass filter.

Also, one terminal of the capacitor C7 is connected to the node between the resistors R14 and R15, and the other terminal of the capacitor C7 is grounded. The capacitor C7 restricts fluctuations in the voltage at the other terminal of the first winding of the transformer 1208.

The capacitor C6 is provided between the power-supply voltage Vs and the ground voltage GND, and restricts fluctuations in the power-supply voltage Vs.

The second low-pass filter 1207 takes out a sine wave from the switch output signal S36 being a PWM signal, generates the sine-wave signal S37, and transmits the sine-wave signal S37 to the transformer 1208.

The transformer 1208 includes the first winding and the second winding. The first winding is connected to the second low-pass filter 1207.

The capacitor C9 is connected between one terminal and the other terminal of the second winding. Further, one terminal of the second winding is connected to the charging roller 13K through the resistor R26. The other terminal of the second winding is connected to the DC output unit 1250. Accordingly, the output voltage Vo (the output current Io), in which the AC output voltage Vac (the AC output current Iac) output from the AC output unit 1200 is superposed on the DC output voltage Vdc (the DC output current Idc) output from the DC output unit 1250, is applied to the charging roller 13K.

The AC current detection circuit 1209 includes diodes D2 and D3, a resistor R15, and capacitors C10 and C11.

One terminal of the capacitor C10 is connected to the input terminal of the AC current detection circuit 1209, the input terminal also being the other terminal of the second winding of the transformer 1208. The other terminal of the capacitor C10 is connected to the cathode terminal of the diode D2 and the anode terminal of the diode D3. The anode terminal of the diode D2 is grounded. The cathode terminal of the diode D3 is commonly connected to one terminal of the resistor R15 and one terminal of the capacitor C11. The other terminal of the resistor R15 and the other terminal of the capacitor C11 are grounded.

The cathode terminal of the diode D3 is connected to the output terminal of the AC current detection circuit 1209, the output terminal also being the negative input terminal of the error amplifier Amp1, through the resistor R5 of the amplifier circuit 1202, and transmits the detection signal S51 to the amplifier circuit 1202.

The AC output current Iac flowing for electrically charging the photoconductor drum 12K through the charging roller 13K is input to the diode D3 through the capacitor C10, and is rectified. The AC output current Iac is converted into a voltage by the resistor R15, and becomes the detection signal S51.

DC Output Unit 1250

As shown in FIG. 3, the DC output unit 1250, the illustration of which is omitted in FIG. 2, includes an analog-voltage conversion circuit 1251, an amplifier circuit 1252, a control circuit 1253, a switch circuit 1254, a transformer 1255, a rectifier circuit 1256, and a DC voltage detection circuit 1257.

The respective circuits are described below.

The analog-voltage conversion circuit 1251 receives the DC voltage setting signal S4 transmitted from the image output controller 30. Similarly to the AC current setting signal S3, the DC voltage setting signal S4 is a PWM signal, and sets the value of the DC output voltage Vdc output from the rectifier circuit 1256 by the duty ratio.

The analog-voltage conversion circuit 1251 has a circuit configuration similar to the analog-voltage conversion circuit 1201 of the AC output unit 1200, and includes a buffer B2, resistors R16, R17, and R18, and a capacitor C12.

One terminal of the resistor R16 is the input terminal of the analog-voltage conversion circuit 1251, and receives the DC voltage setting signal S4. The other terminal of the resistor R16 is connected to the input terminal of the buffer B2. Also, the input terminal of the buffer B2 is connected to one terminal of the resistor R17. The other terminal of the resistor R17 is grounded (the ground voltage GND).

The output terminal of the buffer B2 is connected to one terminal of the resistor R18. The other terminal of the resistor R18 is the output terminal of the analog-voltage conversion circuit 1251, and transmits the analog voltage signal S41 to the amplifier circuit 1252. Also, the other terminal of the resistor R18 is connected to one terminal of the capacitor C12. The other terminal of the capacitor C12 is grounded (the ground voltage GND).

Also, the buffer B2 is supplied with a reference voltage Vref and the ground voltage GND.

When the analog-voltage conversion circuit 1251 receives the DC voltage setting signal S4 being a PWM signal, the voltage of the capacitor C12 is discharged to be a voltage between the reference voltage Vref being the power-supply voltage (High voltage) of the buffer B2 and the reference voltage (Low voltage). This voltage is determined by the duty ratio of the DC voltage setting signal S4. Accordingly, the DC voltage setting signal S4 being the PWM signal is converted into an analog voltage signal S41 being a DC voltage.

The amplifier circuit 1252 includes an error amplifier Amp3, resistors R19, R20, R21, and R22, and a capacitor C13.

One terminal of the resistor R19 is the input terminal of the amplifier circuit 1252, and receives the analog voltage signal S41 form the analog-voltage conversion circuit 1251. The other terminal of the resistor R19 is connected to the negative input terminal of the error amplifier Amp3. The positive input terminal of the error amplifier Amp3 is connected to the DC voltage detection circuit 1257 through the resistor R21, and receives a detection signal S42.

The resistor R20 and the capacitor C13 are connected in series, the terminal of the resistor R20 not connected to the capacitor C13 is connected to the negative input terminal of the error amplifier Amp3. The terminal of the capacitor C13 not connected to the resistor R20 is connected to the output terminal of the error amplifier Amp3.

The output terminal of the error amplifier Amp3 is connected to one terminal of the resistor R22. The other terminal of the resistor R22 is the output terminal of the amplifier circuit 1252, and transmits an error amplification signal S43, which is obtained by the error amplifier Amp3 amplifying the difference between the analog voltage signal S41 and the detection signal S42, to the control circuit 1253.

On the basis of the error amplification signal S43, the control circuit 1253 transmits a driving signal S44 of turning on an npn transistor Tr5 being a switching element in the switch circuit 1254 to the switch circuit 1254.

The switch circuit 1254 includes the npn transistor Tr5 as the switching element. The base terminal of the npn transistor Tr5 is connected to the control circuit 1253 and receives the driving signal S44. Also, the base terminal and the collector terminal of the npn transistor Tr5 are connected to the transformer 1255. The emitter terminal of the npn transistor Tr5 is grounded (the ground voltage GND).

The operation of the npn transistor Tr5 is described later with the operation of the transformer 1255.

The transformer 1255 includes a first winding and a second winding. One terminal of the first winding is set at the power-supply voltage Vs, and the other terminal of the first winding is connected to the collector terminal of the npn transistor Tr5. In contrast, one terminal of a first auxiliary winding is commonly connected to the base terminal of the npn transistor Tr5 of the switch circuit 1254 and toe the control circuit 1253. The other terminal of the first auxiliary winding is grounded (the ground voltage GND).

Both terminals of the second winding of the transformer 1255 are connected to the rectifier circuit 1256.

The rectifier circuit 1256 includes a diode D4, a resistor R23, and a capacitor C14. The cathode terminal of the diode D4 is connected to one terminal of the second winding of the transformer 1255, and the anode terminal of the diode D4 is connected to one terminal of the resistor R23 and one terminal of the capacitor C14. The other terminal of the resistor R23 is connected to the output terminal of the rectifier circuit 1256 being the other terminal of the transformer 1208 of the AC output unit 1200. Also, the other terminal of the capacitor C14 is connected to the other terminal of the second winding of the transformer 1255.

The rectifier circuit 1256 converts the voltage induced by the second winding into a negative (−) DC output voltage Vdc (a DC output current Idc).

The DC voltage detection circuit 1257 includes resistors R24 and R25, and a capacitor C15.

The resistor R25 and the capacitor C15 are connected in parallel. One terminal of the parallel connection is connected to the other terminal of the resistor R23 being the output terminal of the rectifier circuit 1256 through the resistor R24. Also, the other terminal of the parallel connection of the resistor R25 and the capacitor C15 is connected to the other terminal of the capacitor C14 of the rectifier circuit 1256 and is set at a reference voltage Vref.

The reference voltage Vref is set so that the voltage at the positive input terminal of the error amplifier Amp3 in the amplifier circuit 1252 does not become negative.

The DC output voltage Vdc is divided by the resistor R24 and the resistor R25. Hence, the DC voltage detection circuit 1257 detects (monitors) the voltage appearing at the resistor R25, and transmits a detection signal S42 being proportional to the DC output voltage Vdc to the amplifier circuit 1252.

The operations of the switch circuit 1254 and the transformer 1255 of the DC output unit 1250 are described.

When the switch circuit 1254 receives the positive (+) driving signal S44 of turning on the npn transistor Tr5 from the control circuit 1253, the npn transistor Tr5 is turned on. Then, the current flows between the collector terminal and the emitter terminal of the npn transistor Tr5 through the first winding of the transformer 1255.

Since the current flows to the first winding of the transformer 1255, a voltage that increases the voltage at the base terminal of the npn transistor Tr5 is generated at the first auxiliary winding. Accordingly, collector current of the npn transistor Tr5 increases with time.

Although a voltage is generated at the second winding, since the direction of the diode D4 is opposite to the direction of the voltage, current does not flow to the second winding.

The amplification ratio of the npn transistor Tr5 is limited. Hence, when the collector current reaches a certain value or higher, the collector current is not further increased. The change in magnetic flux of the core of the first winding is stopped. Then, a force that causes the current to flow in the same direction as the direction in which the current was flowing, and a voltage in the opposite direction is generated. Accordingly, a voltage in the same direction as the direction of the diode D4 is generated in the second winding, and current flows in the second winding.

In contrast, a voltage in the opposite direction is also generated in the first auxiliary winding by the voltage generated in the opposite direction in the first winding, and provides an inverse bias between the base terminal and the emitter terminal of the npn transistor Tr5. Accordingly, the npn transistor Tr5 is turned off.

When the current flowing to the diode D4 becomes 0, the voltages generated at the first winding, the first auxiliary winding, and the second winding become 0 V. The condition between the base terminal and the emitter terminal of the npn transistor Tr5 is increased again to the positive (+) side by the driving signal S44 from the control circuit 1253. Accordingly, the npn transistor Tr5 is turned on again.

In this way, by switching (turning on and off) the npn transistor Try, the DC output voltage Vdc is generated with the current flowing in the second winding in the time period of being off.

Waveform Setting Unit 60

The waveform setting unit 60 is described next.

Figure 4A:
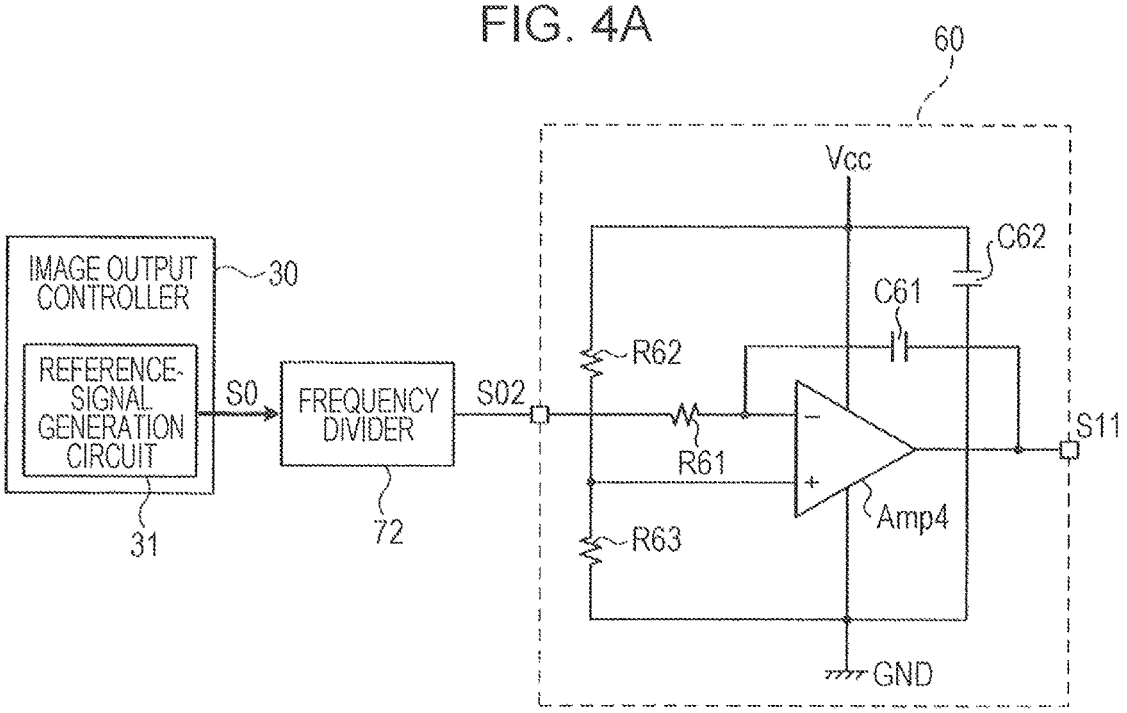
FIGS. 4A and 4B provide a circuit diagram showing an example of the waveform setting unit according to this exemplary embodiment, and an illustration showing waveforms of a clock signal and a modulation signal, FIG. 4A being a circuit diagram of the waveform setting unit, FIG. 4B illustrating waveforms of the clock signal and the modulation signal.
Figure 4B:
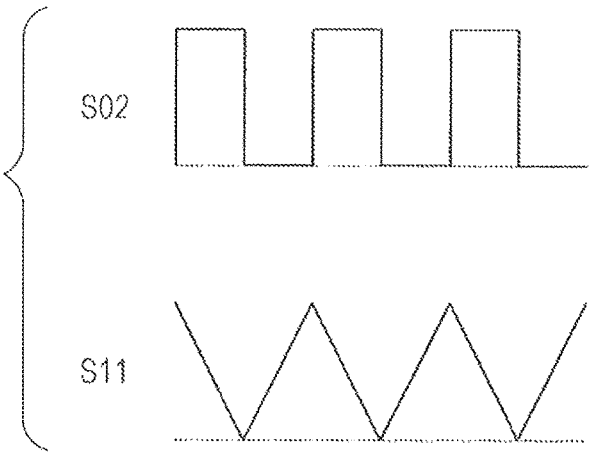

FIGS. 4A and 4B provide a circuit diagram showing an example of the waveform setting unit 60 according to this exemplary embodiment, and an illustration showing the waveforms of the clock signal S02 and the modulation signal S11. In short, FIG. 4A is a circuit diagram of the waveform setting unit 60, and FIG. 4B illustrates the waveforms of the clock signal S02 and the modulation signal S11.

As shown in FIG. 4A, the reference-signal generation circuit 31 of the image output controller 30 generates the reference signal S0, and transmits the reference signal S0 to the frequency divider 72. The frequency divider 72 divides the reference signal S0 by a predetermined division ratio, and generates the clock signal S02. As shown in FIG. 4B, the clock signal S02 is a rectangular wave signal.

As shown in FIG. 4A, the waveform setting unit 60 includes an error amplifier Amp4, resistors R61, R62, and R63, and capacitors C61 and C62.

One terminal of the resistor R61 being the input terminal of the waveform setting unit 60 is connected to the frequency divider 72 and receives the clock signal S02 from the frequency divider 72. The clock signal S02 is a rectangular signal with a duty ratio of 50%.

The other terminal of the resistor R61 is connected to the negative input terminal of the error amplifier Amp4. The capacitor C61 is provided between the output terminal and the negative input terminal of the error amplifier Amp4.

The positive input terminal of the error amplifier Amp4 is connected to the node between the resistors R62 and R63, which are connected in series between a power-supply voltage Vcc (for example, 5 V) of the error amplifier Amp4 and the ground (the ground voltage GND).

Also, the capacitor C62 is provided between the power-supply voltage Vcc of the error amplifier Amp4 and the ground (the ground voltage GND).

The resistors R62 and R63 divide the voltage between the power-supply voltage Vcc and the ground (the ground voltage GND), and sets a voltage of the positive input terminal of the error amplifier Amp4.

The capacitor C62 is provided to restrict fluctuations in voltage between the power-supply voltage Vcc and the ground (the ground voltage GND).

The error amplifier Amp4 discharges the capacitor C61 if the voltage of the negative input terminal is higher than the voltage of the positive input terminal, and charges the capacitor C61 if the voltage of the negative input terminal is lower than the voltage of the positive input terminal. Accordingly, as shown in FIG. 4B, the modulation signal S11 being a triangular wave signal is obtained. The modulation signal S11 has a frequency that is the repetitive frequency of the clock signal S02.

In this exemplary embodiment, the modulation signal S11 is generated on the basis of the reference signal S0 generated by the reference-signal generation circuit 31 of the image output controller 30. That is, the modulation signal S11 has a correlation to the reference signal S0.

The clock signal S02 in FIG. 4A may be generated without correlation to the reference signal S0 by using a rectangular wave generation circuit. However, the modulation signal S11 generated from the clock signal S02 in this case has no correlation to the reference signal S0.

Operation of Charging-Bias Power-Supply Unit 13*a*K

The operation of the charging-bias power-supply unit 13*a*K is described next by using a time chart.

Figure 5:
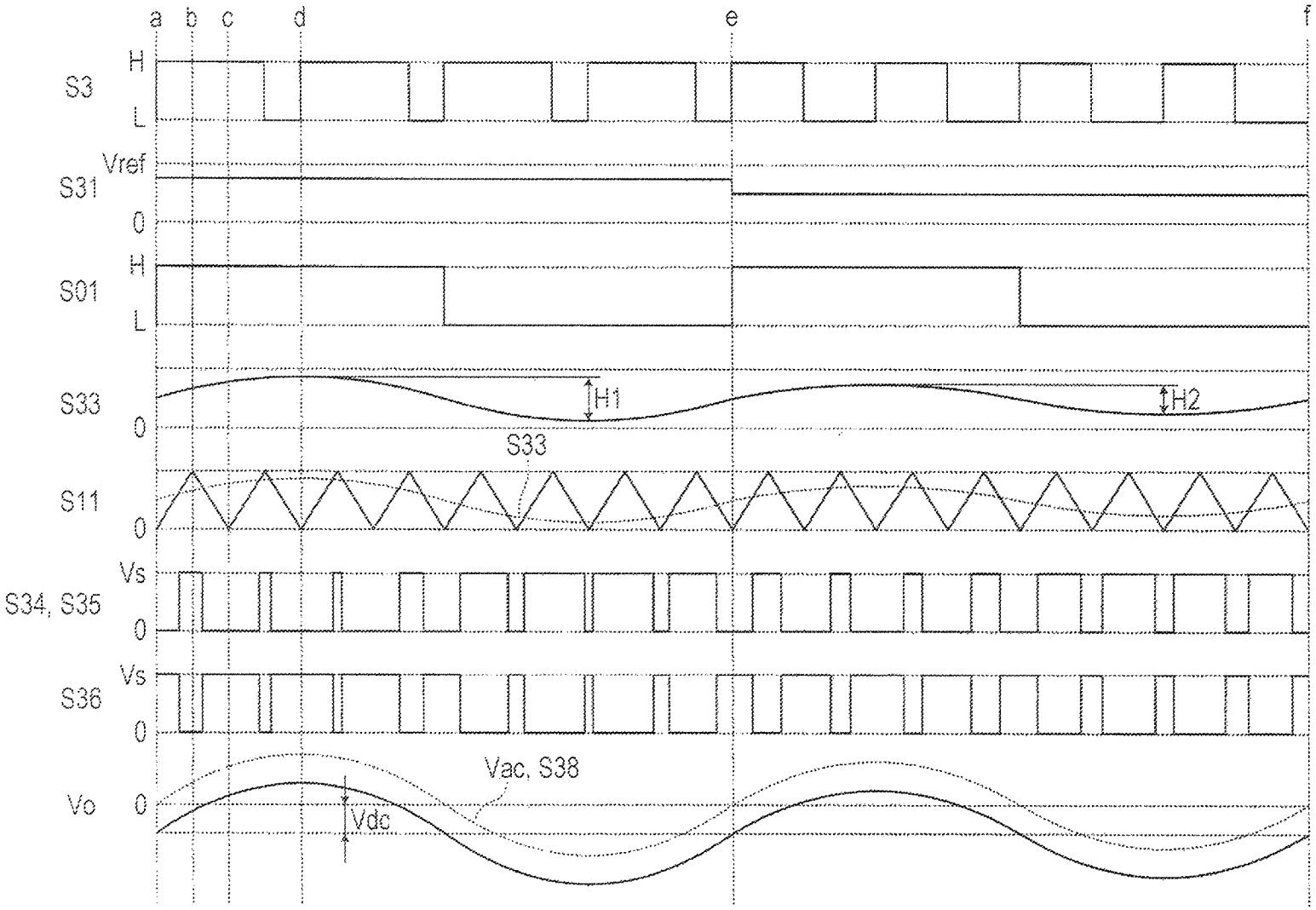
FIG. 5 is a time chart explaining an operation of the charging-bias power-supply unit according to this exemplary embodiment.

FIG. 5 is a time chart explaining the operation of the charging-bias power-supply unit 13*a*K according to this exemplary embodiment. FIG. 5 illustrates the AC current setting signal S3, the analog voltage signal S31, the clock signal S01, the frequency setting signal S33, the modulation signal S11, the modulation output signal S34, the switch output signal S36, and the output voltage Vo sequentially in the order from the upper side.

In FIG. 6, it is assumed that the time elapses in the order of alphabet, such as time a, time b, time c, and so forth.

The AC current setting signal S3 is transmitted from the image output controller 30 to the charging-bias power-supply unit 13*a*K. The AC current setting signal S3 is a PWM signal having two values of "L" and "H," and the time period of "L" and the time period of "H" in a single period are set by a predetermined ratio (a duty ratio). For example, "L" is the ground voltage GND (0 V), and "H" is 5 V. The current value of the AC output current Iac is set by the duty ratio.

In FIG. 5, it is assumed that the time period from time a to time d is a single period of the AC current setting signal S3. The AC current setting signal S3 has a duty ratio of 75% in a time period from time a to time e, and has a duty ratio of 50% in a time period from time e to time f.

The analog voltage signal S31 is generated by the analog-voltage conversion circuit 1201 which has received the AC current setting signal S3. As shown in FIG. 3, the analog-voltage conversion circuit 1201 generates the analog voltage signal when the capacitor C1 is charged by the AC current setting signal S3.

That is, the analog voltage signal S31 is set so that the voltage is 75% of the reference voltage Vref in the time period from time a to time e in which the duty ratio of the AC current setting signal S3 is 75% and the voltage is 50% of the reference voltage Vref in the time period from time e to time f in which the duty ratio is 50%. That is, the voltage of the analog voltage signal S31 is set by the duty ratio of the AC current setting signal S3.

The clock signal S01 is a signal obtained by the frequency divider 71 dividing the reference signal S0 generated by the reference-signal generation circuit 31 of the image output controller 30. The clock signal S01 includes two values of "L" and "H," has a duty ratio of 50%, and has a repetitive frequency being the frequency of the AC output signal S38 (the AC output voltage Vac, the AC output current Iac).

FIG. 5 illustrates that the clock signal S01 has a frequency that is ⅛ the frequency of the modulation signal S11 (described later) for the convenience of description.

To describe the frequency setting signal S33, the operation of the first low-pass filter 1203 and the error amplification signal S32 are described next with reference to FIG. 3.

As shown in FIG. 3, the clock signal S01 is input to the base terminal of the npn transistor Tr1 of the first low-pass filter 1203. The npn transistor Tr1 is turned on and the collector terminal becomes the ground voltage GND in a time period in which the clock signal S01 is "H," and the npn transistor Tr1 is turned off and the collector terminal becomes the reference voltage Vref in a time period in which the clock signal S01 is "L." In this case, it is assumed that the reference voltage Vref is a positive voltage, and is, for example, 5 V.

The collector terminal of the npn transistor Tr1 is connected to the base terminal of the npn transistor Tr2. Hence, in the time period in which the collector terminal of the npn transistor Tr1 is the reference voltage Vref (in the time period in which the clock signal S01 is "L"), the npn transistor Tr2 is on and the collector terminal is the ground voltage GND. In contrast, in the time period in which the collector terminal of the npn transistor Tr1 is the ground voltage GND (in the time period in which the clock signal S01 is "H"), the npn transistor Tr2 is off and the collector terminal of the npn ground voltage Tr2 is in a floating condition.

In this case, the error amplification signal S32 being the output of the amplifier circuit 1202 is a signal obtained by the error amplifier Amp1 amplifying the difference between the voltage of the analog voltage signal S31 and the detection signal S51 output from the AC current detection circuit 1209. That is, the error amplification signal S32 is a signal corresponding to (proportional to) the analog voltage signal S31.

When the error amplification signal S32 is input to the first low-pass filter 1203, the error amplification signal S32 is modulated by the diode D1. In the time period in which the collector terminal of the npn transistor Tr2 is the ground voltage GND (in the time period in which the clock signal S01 is "L"), the diode D1 becomes a forward bias and the error amplification signal S32 is drawn to the ground voltage GND. In contrast, in the time period in which the collector terminal of the npn transistor Tr2 is in a floating condition (in the time period in which the clock signal S01 is "H"), the diode D1 does not become a forward bias, and the error amplification signal S32 is held. That is, the error amplification signal S32 is modulated by the clock signal S01 in the first low-pass filter 1203.

The error amplification signal S32 modulated by the clock signal S01 becomes the frequency setting signal S33 being a sine wave by passing through the low-pass filter including the error amplifier Amp2 in the first low-pass filter 1203.

As shown in FIG. 5, the amplitude (the p-p value) of the frequency setting signal S33 is set by the analog voltage signal S31 (that is, the AC current setting signal S3 in FIG. 5). That is, an amplitude H1 in the time period in which the duty ratio of the AC current setting signal S3 is 75% from time a to time e is larger than an amplitude H2 in the time period in which the duty ratio of the AC current setting signal S3 is 50% from time e to time f (75/50=1.25 times).

In this case, it is assumed that the influence is not provided by the detection signal S51 output from the AC current detection circuit 1209.

The modulation signal S11 is a triangular wave a single period of which is a time period from time a to time c. A time period from time a to time b corresponds to a rise of the triangular wave, and a time period from time b to time c corresponds to a fall of the triangular wave.

FIG. 5 illustrates that the frequency of the AC current setting signal S3 is ½ the frequency of the modulation signal S11, for the convenience of description.

As described above, the comparator Cmp of the modulation circuit 1204 compares the voltage of the frequency setting signal S33 with the voltage of the modulation signal S11 being the triangular wave, generates the modulation output signal S34 that becomes the power-supply voltage Vs in the time period in which the voltage of the modulation signal S11 is higher than the voltage of the frequency setting signal S33 and that becomes the ground voltage GND in the time period in which the voltage of the modulation signal S11 is lower than the voltage of the frequency setting signal S33, and transmits the modulation output signal S34.

FIG. 5 illustrates the frequency setting signal S33 by a broken line in a superposing manner on the modulation signal S11. The modulation output signal S34 becomes a PWM signal having a pulse width set in accordance with the magnitude relationship between voltages of the modulation signal S11 and the frequency setting signal S33.

As shown in FIG. 3, the field-effect transistors FET1 and FET2 of the switch circuit 1206 are alternately turned on and off by the driving signal S35 having the same magnitude relationship between voltages as the modulation output signal S34 (in FIG. 5, expressed as S34, S35). As described above, when the modulation output signal S34 (the driving signal S35) is the ground voltage GND, the field-effect transistor FET1 is turned off and the field-effect transistor FET2 is turned on, and the switch output signal S36 from the switch circuit 1206 becomes the power-supply voltage Vs. In contrast, when the modulation output signal S34 (the driving signal S35) is the power-supply voltage Vs, the field-effect transistor FET1 is turned on and the field-effect transistor FET2 is turned off, and the switch output signal S36 from the switch circuit 1206 becomes the ground voltage GND. That is, as shown in FIG. 5, the magnitude relationship between voltages of the modulation output signal S34 (the driving signal S35) is inverted to the magnitude relationship between voltages of the switch output signal S36.

The second low-pass filter 1207 takes out the sine-wave signal S37 from the switch output signal S36 being the output of the switch circuit 1206. The sine-wave signal S37 becomes the AC output signal S38 (the AC output voltage Vac) through the transformer 1208.

Also, the DC output unit 1250 operates similarly. As shown in FIG. 3, the analog-voltage conversion circuit 1251 generates the analog voltage signal S41 the voltage of which is set by the duty ratio of the DC voltage setting signal S4, and transmits the analog voltage signal S41 to the amplifier circuit 1252. The amplifier circuit 1252 amplifies the difference between the voltage of the analog voltage signal S41 and the voltage of the detection signal S42 from the DC voltage detection circuit 1257, and transmits the error amplification signal S43 to the control circuit 1253. The control circuit 1253 generates the voltage that turns on the npn transistor Tr5 of the switch circuit 1254. As described above, since the npn transistor Tr5 of the switch circuit 1254 is repetitively turned on and off (switching), a voltage is induced in the second winding of the transformer 1255.

The rectifier circuit 1256 rectifies the induced voltage and outputs the DC output voltage Vdc.

Then, the output voltage Vo in which the AC output voltage Vac and the DC output voltage Vdc are superposed is output from the charging-bias power-supply unit 13*a*K, and is applied to the charging roller 13K. Accordingly, the DC output current Idc and the AC output current Iac flow from the charging roller 13K to the photoconductor drum 12K.

As described above, if the DC output voltage Vdc is −600 V, the AC output voltage Vac has a frequency of 2 kHz, and a p-p value of 2 kV, the output voltage Vo oscillates to the positive and negative around the ground voltage GND (0 V) as shown in FIG. 5.

As shown in FIG. 3, the AC current detection circuit 1209 detects (monitors) the AC output current Iac, and transmits the detection signal S51, which has been converted into a voltage. The negative input terminal of the error amplifier Amp1 of the amplifier circuit 1202 receives the detection signal S51 through the resistor R5. Then, the error amplifier Amp1 controls the amplitude of the frequency setting signal S33 by amplifying the difference between the voltage of the analog voltage signal S31 received by the positive input terminal and the voltage of the detection signal S51 received by the negative input terminal.

In contrast, the DC voltage detection circuit 1257 detects (monitors) the DC output voltage Vdc, and transmits the detection signal S42 proportional to the DC output voltage Vdc. The positive input terminal of the error amplifier Amp3 of the amplifier circuit 1252 receives the detection signal S42 through the resistor R21. Then, the error amplifier Amp3 controls the value of the DC output voltage Vdc by amplifying the difference between the voltage of the detection signal S42 received by the positive input terminal and the voltage of the analog voltage signal S41 received by the negative input terminal.

The charging-bias power-supply unit 13*a*K operates in this way.

The charging-bias power-supply unit 13*a*K generates the switch output signal S36 by switching (turning on and off) the field-effect transistors FET1 and FET2 of the switch circuit 1206 on the basis of the modulation signal S11. The switch output signal S36 is a PWM signal. The second low-pass filter 1207 causes the switch output signal S36 to be the sine-wave signal S37. The voltage of the sine-wave signal S37 is increase by the transformer 1208, and the sine-wave signal S37 becomes the AC output signal S38 (the AC output voltage Vac, the AC output current Iac).

However, waveform disorder caused by switching (turning on and off) of the switch circuit 1206 is superposed on the sine-wave signal S37. That is, the sine-wave signal S37 is not a smooth sine wave, but has a waveform in which undulations (serrations) that fluctuate with the frequency of the modulation signal S11 are superposed on the sine wave. Hence, in the AC output signal S38, undulations that fluctuate with the modulation signal S11 are superposed on the sine wave.

In this case, if the frequency of the AC output signal S38 is an integral multiple of the frequency of the modulation signal S11, the undulations appearing in the AC output signal S38 and corresponding to the modulation signal S11 are superposed at the position of the same phase in each period of the AC output signal S38. That is, the AC output signal S38 repeats the same waveform every period.

In the charging bias, the AC output voltage Vac is superposed on the DC output voltage Vdc. At this time, the frequency of the AC output signal S38 is set at, for example, 2 kHz to restrict appearance of stripes with different densities (density unevenness, hereinafter, referred to as banding) corresponding to unevenness of the charging bias. That is, even if the AC output signal S38 (the AC output voltage Vac) is superposed on the DC output voltage Vdc, banding caused by the AC output signal S38 does not appear because the frequency is high (described later).

If the frequency of the modulation signal S11 is an integral multiple of the AC output signal S38, interference with a frequency lower than the frequency of the AC output signal S38 is not generated. Hence, fluctuations in the DC level (the DC output voltage Vdc) of the output voltage Vo are restricted in a period longer than the period of the AC output signal S38. Accordingly, banding does not appear.

If the frequency of the AC output signal S38 is not an integral multiple of the frequency of the modulation signal S11, the undulations corresponding to the frequency of the modulation signal S11 are superposed in different phases in respective periods of the AC output signal S38. Accordingly, in the AC output signal S38, the harmonic of the AC output signal S38 interferes with the modulation signal S11, and oscillation with a lower frequency than the frequency of the AC output signal S38 is generated. The frequency of the oscillation corresponds to the difference between the frequency of the harmonic of the AC output signal S38 and the frequency of the modulation signal S11. In this case, a signal of the frequency of the difference is referred to as a signal caused by interference. The frequency of the difference is referred to as a frequency of interference (interference frequency).

The oscillation with a lower frequency than the frequency of the AC output signal S38 generates fluctuations in the DC level (the DC output voltage Vdc) of the output voltage Vo in a longer period than the period of the AC output signal S38.

For example, it is assumed that the signal caused by interference is superposed on the charging bias of the charging roller 13 that electrically charges the photoconductor drum 12. Then, unevenness (fluctuations) of the charging bias (the DC level) is generated on the surface of the photoconductor drum 12 in accordance with the interference frequency. Owing to this, banding corresponding to the unevenness of the charging bias is generated on a recording paper with an image formed.

If intervals between stripes with different densities due to banding appear (are visually recognizable), this may deteriorate the quality (the image quality) of the image.

That is, in the AC output signal S38, in addition to the sine wave being the fundamental wave of the AC output signal S38, a signal generated by interference between the harmonic of the sine wave being the fundamental wave of the AC output signal S38 and the modulation signal S11 is superposed as a component.

In these signals, a signal with a lower frequency than the frequency of the AC output signal S38 may cause banding to appear.

In this exemplary embodiment, the AC output signal S38 is generated by the frequency divider 71 dividing the reference signal S0 generated by the reference-signal generation circuit 31 of the image output controller 30. Also, the modulation signal S11 is generated by the frequency divider 72 dividing the reference signal S0 generated by the reference-signal generation circuit 31 of the image output controller 30. That is, the reference signals S0 divided by the frequency dividers 71 and 72 are common.

Hence, since the frequency of the AC output signal S38 correlates to the frequency of the modulation signal S11, it is difficult to set one of these frequencies to be an integral multiple of the other.

Also, if the image forming apparatus 1 uses frequencies of plural AC output signals S38, even if the frequency of one of the AC output signals S38 may be set to be an integral multiple of the frequency of the modulation signal S11, the frequencies of the other AC output signals S38 may not be set to be integral multiples of the frequency of the modulation signal S11.

FIG. 6 is an illustration explaining the AC output signal S38, the modulation signal S11, and the relationship in interference frequency between the AC output signal S38 and the modulation signal S11.

In this case, it is assumed that the frequency of the reference signal S0 is 50 MHz, and the frequency of the AC output signal S38 is 2800.0224 Hz when the division ratio is 17857 to the reference signal S0 being 50 MHz. The frequencies of the modulation signals S11 are set in a range from 70 kHz to 101 kHz.

Then, the harmonics of the AC output signal S38 become 28 to 36 times the frequency range of the modulation signals S11. That is, the frequencies of the harmonics of the AC output signal S38 are as shown in FIG. 6.

The closest frequencies of the modulation signals S11 respectively to the frequencies of the harmonics of the AC output signal S38 correspond to division ratios of 496 to 638 with respect to 50 MHz of the reference signal S0.

In this range, the modulation signal S11 having a frequency that matches (that is an integral multiple of) the frequency of the harmonic of the AC output signal S38 is not selected.

The interference frequencies (Hz) being the differences between the frequencies of the harmonics of the AC output signal S38 and the frequencies of the modulation signals S11 are in a range from 4 Hz to 39 Hz as shown in FIG. 6.

When p (mm) is a banding pitch (interval), v (mm/s) is a speed of the outer periphery (peripheral velocity, process speed) of the photoconductor drum 12, and f (Hz) is an interference frequency, the banding pitch p is expressed by p=v/f. That is, the banding pitch p is inversely proportional to the interference frequency f.

For example, if the process speed v is 300 mm/v, and if the interference frequency f is 30 Hz, the banding pitch p becomes 10 mm.

Although described later, if the banding pitch p becomes 10 mm, banding appears (is visually recognized).

As described above, when the modulation signal S11 is set at a frequency close to a harmonic (a frequency of an integral multiple) of the AC output signal S38, the banding may appear.

In the following description, the banding pitch may be referred to as the banding pitch p, the speed of the outer periphery (peripheral velocity, process speed) of the photoconductor drum 12 may be referred to as the peripheral velocity (process speed) v of the photoconductor drum 12, and the interference frequency may be referred to as the interference frequency f.

In this exemplary embodiment, the modulation signal S11 is set at a frequency separated from a harmonic (a frequency of an integral multiple) of the AC output signal S38.

FIGS. 7A and 7B illustrate cases in which the frequencies of the modulation signals S11 are set at, for example, a frequency being 33 times the frequency of the AC output signal S38 and a frequency being 34 times the frequency of the AC output signal S38. FIG. 7A illustrates a case in which the frequency of the modulation signal S11 is set at a frequency close to an intermediate frequency between the frequency being 33 times the frequency of the AC output signal S38 and the frequency being 34 times the frequency of the AC output signal S38. FIG. 7B illustrates a case in which the frequency of the modulation signal S11 is set at a frequency separated from the intermediate frequency between the frequency being 33 times the frequency of the AC output signal S38 and the frequency being 34 times the frequency of the AC output signal S38. It is assumed that the modulation signal S11 is set between the frequency being 33 times the frequency of the AC output signal S38 and the frequency being 34 times the frequency of the AC output signal S38.

In this case, the harmonic being 33 times the frequency of the AC output signal S38 is referred to as a harmonic of the AC output signal S38 next to the modulation signal S11 at the low frequency side, and the harmonic being 34 times the frequency of the AC output signal S38 is referred to as a harmonic of the AC output signal S38 next to the modulation signal S11 at the high frequency side. There is no harmonic of the AC output signal S38 between these two harmonic.

An intermediate frequency between about 92401 Hz of a frequency being 33 times the frequency of the AC output signal S38 and about 95201 Hz of a frequency being 34 times the frequency of the AC output signal S38 is about 93801 Hz. (Hereinafter, a number is round off to the integer, and "about" is added to the integer.) The frequency of the modulation signal S11 close to the intermediate frequency is about 93809 Hz with a division ratio being 533 as shown in FIG. 7A.

Since the modulation signal S11 is set at about 93809 Hz, the interference frequency (an example of a first interference frequency) between the harmonic being 33 times the frequency of the AC output signal S38 and the modulation signal S11 is about 1408 Hz. Also, the interference frequency (an example of a second interference frequency) between the harmonic being 34 times the frequency of the AC output signal S38 and the modulation signal S11 is about 1392 Hz.

If the interference frequency f is 1000 Hz or higher, and if the peripheral velocity (process speed) v of the photoconductor drum 12 is 300 mm/s, the banding pitch p is 0.3 mm or smaller. Although described later, if the banding pitch p becomes 0.3 mm or smaller, banding does not appear (is not visually recognized). That is, even if banding is present, the banding does not deteriorate the image quality.

As shown in FIG. 7A, the frequency being the difference between the two interference frequencies (in FIG. 7A, expressed as interference between interferences) is as low as about 16 Hz. That is, interference may be generated even between the signals of these two interference frequencies, and banding may appear (be visually recognized).

If banding appears (is visually recognized) by interference between the signals of the two interference frequencies, as shown in FIG. 7B, the frequency of the modulation signal S11 may be shifted from the frequency close to the intermediate frequency between the harmonics (33 times and 34 times) of the AC output signal S38, and the interference frequency between the signals of the two interference frequencies may be increased.

As shown in FIG. 7B, for example, if the frequency of the modulation signal S11 is set at about 93458 Hz with a division ratio of 535, the interference frequency (an example of a first interference frequency) interfering between the harmonic being 33 times the frequency of the AC output signal S38 and the modulation signal S11 is about 1057 Hz. Also, the interference frequency (an example of a second interference frequency) between the harmonic being 34 times the frequency of the AC output signal S38 and the modulation signal S11 is about 1743 Hz. Further, the interference frequency (an example of a third interference frequency) between these two interference frequencies is as high as about 686 Hz.

If the interference frequency f is 686 Hz, and if the peripheral velocity (process speed) v of the photoconductor drum 12 is 300 mm/s, the banding pitch p becomes 0.48 mm. Although described later, the pitch p of 0.48 mm does not appear (is not visually recognized). That is, even if banding is present, the banding does not deteriorate the image quality.

In FIGS. 6, 7A, and 7B, the frequency of the AC output signal S38 is set and then the frequency of the modulation signal S11 is set; however, the frequency of the modulation signal S11 may be set and then the frequency of the AC output signal S38 may be set. Also, the frequency of the modulation signal S11 and the frequency of the AC output signal S38 may be set while the frequency of the modulation signal S11 and the frequency of the AC output signal S38 are mutually changed.

FIG. 8 illustrates the result of evaluation on whether banding appears (is visually recognized) or not. The interference frequency f (Hz), the banding pitch p (mm), and the evaluation result are illustrated from the upper side.

The peripheral velocity (process speed) v of the photoconductor drum 12 is set at 308 mm/s, and the AC signal (the AC output voltage Vac (the AC output current Iac)) is set at 2438 Hz.

Then, if banding does not appear (is not visually recognized), and it is judged that the image quality is not deteriorated, an evaluation is made as "no banding (⊙)." If banding appears (is visually recognized) but is very slight, and it is judged that the image quality is not deteriorated, an evaluation is made as "slight banding (○)." If banding appears (is visually recognized) and it is judged that the image quality is deteriorated, an evaluation is made as "noticeable banding (X)."

As shown in FIG. 8, if the banding pitch p is 0.75 mm or smaller, an evaluation is made as "no banding (⊙)." If the banding pitch p is larger than 0.75 mm and equal to or smaller than 3 mm, an evaluation is made as "slight banding (○)." If the banding pitch p is 3.5 mm, an evaluation is made as "noticeable banding (X)."

As described above, if the banding pitch p is set to 3 mm or smaller, an evaluation is made as no deterioration in image quality.

As described above, the banding pitch p is set by the interference frequency f and the peripheral velocity (process speed) v of the photoconductor drum 12. The higher the interference frequency f is, the smaller the banding pitch p is. Hence, the frequencies of the AC output signal S38 and the modulation signal S11 may be set to increase the interference frequency f generated between the harmonic of the AC output signal S38 and the modulation signal S11.

In this case, for the frequency, the harmonics of the AC output signal S38 next to the modulation signal S11 are used, and the interferences between the harmonics of the AC output signal S38 and the modulation signal S11 as well as the interference generated between the signals generated by the interferences are used. If there is another interference causing banding to appear, the frequencies of the AC output signal S38 and the modulation signal S11 may be set so that the interference frequency of the other interference becomes a frequency not causing banding to appear (not causing banding to be visually recognized).

The AC output signal S38 in the charging bias is, for example, 2 kV p-p as described above. Even if fluctuations (undulations) of several volts are superposed on the sine wave being the fundamental wave of the AC output signal S38, banding may appear (be visually recognized).

Owing to this, according to a precondition that banding is generated, in this exemplary embodiment, the banding pitch is decreased not to cause banding to appear (be visually recognized). That is, the frequencies of the AC output signal S38 and the modulation signal S11 are set to increase the interference frequency between the harmonic of the AC output signal S38 and the modulation signal S11.

Accordingly, deterioration in image quality due to banding is restricted.

Further, in this exemplary embodiment, the clock signal S01 of setting the frequency of the AC output signal S38 and the clock signal S02 of setting the frequency of the modulation signal S11 are generated by dividing the reference signal S0 generated by the reference-signal generation circuit 31 of the image output controller 30.

Hence, the relationship between the phase of the AC output signal S38 and the phase of the modulation signal S11 is fixed. That is, fluctuations in interference frequency are restricted.

If the frequency of the modulation signal S11 is aligned with the frequency of the harmonic of the AC output signal S38, that is, if no interference is generated, and if the frequency of the modulation signal S11 fluctuates due to a disturbance or the like, the fluctuating frequency becomes an interference frequency. For example, if the frequency of the modulation signal S11 fluctuates by 5 Hz, the interference frequency f becomes 5 Hz. Then, as described above, banding appears (is visually recognized), resulting in deterioration in image quality.

However, if the interference frequency f is 500 Hz in this exemplary embodiment, even if the frequency of the modulation signal S11 fluctuates due to a disturbance or the like by 5 Hz, the interference frequency f merely becomes 505 Hz. Therefore, the state in which banding does not appear (is less visually recognized) is maintained.

That is, in this exemplary embodiment, since the interference frequency is set at a high frequency with which banding less appears (is less visually recognized), even if the frequency fluctuates due to a disturbance or the like, appearance (visual recognition) of banding is restricted.

In this exemplary embodiment, the bias power-supply device 100 that supplies the charging bias is described as an example. As described above, the bias power-supply device 100 that supplies the developing bias may be used.

In this exemplary embodiment, a toner of negative polarity charge system is used; however, a toner of positive polarity charge system may be used. In this case, the polarities of the DC output voltage Vdc output from the charging-bias power-supply unit 13*a* and the DC output voltage Vdc output from the developing-bias power-supply unit 15*a* may be inverted (positive (+) voltages).

In this exemplary embodiment, the AC current setting signal S3 (see FIG. 5) and the DC voltage setting signal S4 transmitted by the image output controller 30 are signals each having two voltages of "H" and "L." This is to decrease the influence of noise when these signals are transmitted from the image output controller 30 to the charging-bias power-supply unit 13*a*. Hence, the AC current setting signal S3 and the DC voltage setting signal S4 transmitted by the image output controller 30 may be analog voltage signals, and the analog-voltage conversion circuits 1201 and 1251 of the charging-bias power-supply unit 13*a* may be omitted.

Further, in this exemplary embodiment, the image forming apparatus 1 is tandem system including plural photoconductor drums 12 respectively corresponding to the colors of yellow (Y), magenta (M), cyan (C), and black (K). The image forming apparatus 1 may be multiple (rotary) system including a rotary developing device having developing units respectively corresponding the colors of yellow (Y), magenta (M), cyan (C), and black (K) being rotatably attached.

The foregoing description of the exemplary embodiment of the present invention has been provided for the purposes of illustration and description. It is not intended to be exhaustive or to limit the invention to the precise forms disclosed. Obviously, many modifications and variations will appear to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a charging unit configured to charge the image carrier with electricity;

an exposure unit configured to expose the image carrier charged with the electricity by the charging unit to light, and to form an electrostatic latent image on the image carrier;

a developing unit configured to develop the electrostatic latent image formed on the image carrier by the exposure to the light by the exposure unit; and a transfer unit configured to transfer the developed image on a transfer material, wherein at least one of the charging unit and the developing unit is configured to use an electric field in which an alternating current and a direct current are superposed, the electric field being generated by a bias power supply, the bias power supply including a transformer that includes a first winding and a second winding, and is configured to output an alternating-current output signal from the second winding in a case in which the first winding is supplied with current, a switch circuit that includes a switching element, and is configured to supply the first winding of the transformer with the current by switching the switching element in accordance with a received modulation output signal, and a modulation circuit configured to receive a frequency setting signal and a modulation signal, and to generate the modulation output signal having a modulated pulse width, the frequency setting signal setting a frequency of the alternating-current output signal, and wherein a frequency of the modulation signal and a frequency of the alternating-current output signal are set to cause an interval to be smaller than a predetermined interval, wherein the interval and the predetermined interval respectively comprise a first distance and a second distance between adjacent stripes of different densities, the interval is generated on the transfer material by interference between the modulation signal and a harmonic present in the alternating-current output signal.

2. The image forming apparatus according to claim 1, wherein the frequency of the modulation signal and the frequency of the alternating-current output signal are set with respect to a first interference frequency by interference between the modulation signal and a first harmonic of the alternating-current output signal with a lower frequency than the frequency of the modulation signal, and with respect to a second interference frequency by interference between the modulation signal and a second harmonic of the alternating-current output signal with a higher frequency than the frequency of the modulation signal.

3. The image forming apparatus according to claim 2, wherein the frequency of the modulation signal and the frequency of the alternating-current output signal are set with respect to a third interference frequency being a difference between the first interference frequency and the second interference frequency, in addition to the first interference frequency and the second interference frequency.

4. The image forming apparatus according to claim 1, further comprising:

a first frequency divider configured to divide a frequency of a received reference signal and to set the frequency of the alternating-current output signal; and a second frequency divider configured to divide the frequency of the reference signal and to set the frequency of the modulation signal.

5. The image forming apparatus according to claim 4, wherein the reference signal received by the first frequency divider and the reference signal divided by the second frequency divider are common.

6. The image forming apparatus according to claim 1, wherein the predetermined interval for the interval between the stripes with the different densities generated on the transfer material by the interference between the modulation signal and the harmonic of the alternating-current output signal is 3 mm.

7. A bias power-supply device comprising:

a transformer that includes a first winding and a second winding, and is configured to output an alternating-current output signal from the second winding when the first winding is supplied with current;

a switch circuit that includes a switching element, and is configured to supply the first winding of the transformer with the current by switching the switching element in accordance with a received modulation output signal; and a modulation circuit configured to receive a frequency setting signal and a modulation signal, and further configured to generate the modulation output signal having a modulated pulse width, the frequency setting signal setting a frequency of the alternating-current output signal, wherein a frequency of the modulation signal and a frequency of the alternating-current output signal are set to cause an interference frequency to be higher than a predetermined frequency, wherein the interference frequency is a difference between a frequency of the modulation signal and a frequency of a harmonic present in the alternating-current output signal.

8. The bias power-supply device according to claim 7, wherein the transformer is further configured to supply the alternating-current output signal to a charging roller, and in a case in which the interference frequency is lower than the predetermined frequency, the alternating-current output signal controls the charging roller such that banding is produced on a medium at a greater pitch than in a case in which the interference frequency is higher than the predetermined frequency.

9. The bias power-supply device according to claim 7, further comprising:

an amplifier circuit; and a low-pass filter, wherein the frequency setting signal is a signal output from the transformer to the amplifier circuit as the transformer generates the alternating-current output signal, the frequency setting signal is amplified by the amplifier circuit and output to the modulation circuit through the low-pass filter, and the modulation circuit is configured to modulate the modulation output signal according to the frequency setting signal modulated by the modulation signal.

10. The bias power-supply device according to claim 9, further comprising:

an analog-voltage conversion circuit configured to convert and transmit a setting signal from an image output controller to the amplifier circuit, wherein the amplifier circuit is further configured to amplify the frequency setting signal with respect to the setting signal, and the low-pass filter is further configured to transmit the frequency setting signal to the modulation circuit with respect to a clock signal frequency divided from a reference signal of the image output controller, and the modulation signal is frequency divided from the reference signal at a different ratio than the clock signal is frequency divided from the reference signal.

* * * * *